US011143985B2

(12) United States Patent
Saeki

(10) Patent No.: US 11,143,985 B2
(45) Date of Patent: Oct. 12, 2021

(54) IMAGE FORMING APPARATUS INCLUDING FIRST AND SECOND CAMS WHOSE ROTATION ANGLES ARE OFFSET, AND FIRST AND SECOND RODS THAT MOVE, BY ROTATIONS OF FIRST AND SECOND CAMS, FIRST AND SECOND DEVELOPING ROLLERS TOWARD AND AWAY FROM FIRST AND SECOND PHOTOSENSITIVE DRUMS, RESPECTIVELY

(71) Applicant: BROTHER KOGYO KABUSHIKI KAISHA, Nagoya (JP)

(72) Inventor: Masahito Saeki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/015,388

(22) Filed: Sep. 9, 2020

(65) Prior Publication Data

US 2020/0409290 A1 Dec. 31, 2020

Related U.S. Application Data

(63) Continuation of application No. PCT/JP2018/045628, filed on Dec. 12, 2018.

(30) Foreign Application Priority Data

Mar. 30, 2018 (JP) ..... JP2018-067792

(51) Int. Cl.
*G03G 15/08* (2006.01)
*G03G 21/16* (2006.01)
*G03G 21/18* (2006.01)

(52) U.S. Cl.
CPC ..... *G03G 15/0896* (2013.01); *G03G 21/1676* (2013.01); *G03G 21/1814* (2013.01);
(Continued)

(58) Field of Classification Search
CPC .... G03G 15/01; G03G 15/0896; G03G 21/16; G03G 21/1676; G03G 21/1814; G03G 2221/163; G03G 2221/165
See application file for complete search history.

(56) References Cited

U.S. PATENT DOCUMENTS 4,339,196 A 7/1982 Beck et al.
2007/0077090 A1* 4/2007 Kim ..... G03G 15/0194 399/167

(Continued)

FOREIGN PATENT DOCUMENTS

JP 60091341 A * 5/1985
JP S-214448 A 8/1994

(Continued)

OTHER PUBLICATIONS

International Search Report issued in PCT/JP2018/045628, dated Mar. 5, 2018.

(Continued)

*Primary Examiner* — Francis C Gray
(74) *Attorney, Agent, or Firm* — Merchant & Gould P.C.

(57) ABSTRACT

An image forming apparatus includes: a first rod movable between a first advanced position separating a first developing roller from a first photosensitive drum and a first retracted position allowing the first developing roller to contact the first photosensitive drum; a second rod movable between a second advanced position separating a second developing roller from a second photosensitive drum and a second retracted position allowing the second developing roller to contact the second photosensitive drum; a first cam shifting between a first pushing state of placing the first rod in the first advanced position and a first push-released state of allowing the first rod to be in the first retracted position; and a second cam shifting between a second pushing state of placing the second rod in the second advanced position and
(Continued)

a second push-released state of allowing the second rod to be in the second retracted position.

16 Claims, 8 Drawing Sheets

(52) U.S. Cl.
CPC ..... *G03G 2221/163* (2013.01); *G03G 2221/1657* (2013.01)

(56) References Cited

U.S. PATENT DOCUMENTS

| | | | | |
|---|---|---|---|---|
| 2007/0177899 | A1* | 8/2007 | Kawamura | G03G 15/0896 399/223 |
| 2008/0286001 | A1 | 11/2008 | Matsumoto et al. | |
| 2010/0316400 | A1 | 12/2010 | Murasaki et al. | |
| 2012/0014717 | A1 | 1/2012 | Sugiyama | |
| 2014/0169833 | A1 | 6/2014 | Kawamura et al. | |
| 2014/0251755 | A1 | 9/2014 | Suzuki | |
| 2017/0097588 | A1* | 4/2017 | Fukamachi | G03G 15/0891 |
| 2017/0261918 | A1 | 9/2017 | Zensai et al. | |
| 2018/0181056 | A1* | 6/2018 | Itabashi | G03G 15/0806 |
| 2020/0301351 | A1* | 9/2020 | Ooka | G03G 21/1633 |

FOREIGN PATENT DOCUMENTS

| | | | |
|---|---|---|---|
| JP | 2005-070197 | A | 3/2005 |
| JP | 2006-292868 | A | 10/2006 |
| JP | 2007-213023 | A | 8/2007 |
| JP | 2007-279175 | A | 10/2007 |
| JP | 2008-310293 | A | 12/2008 |
| JP | 2011-018017 | A | 1/2011 |
| JP | 2012-022142 | A | 2/2012 |
| JP | 2012-128017 | A | 7/2012 |
| JP | 2014-134780 | A | 7/2014 |
| JP | 2014-170172 | A | 9/2014 |
| JP | 2017-161839 | A | 9/2017 |

OTHER PUBLICATIONS

Written Opinion issued in PCT/JP2018/045628, dated Mar. 5, 2018.
International Preliminary Report on Patentability issued in corresponding International Patent Application No. PCT/JP2018/045628, dated Oct. 6, 2020.

* cited by examiner

IMAGE FORMING APPARATUS INCLUDING FIRST AND SECOND CAMS WHOSE ROTATION ANGLES ARE OFFSET, AND FIRST AND SECOND RODS THAT MOVE, BY ROTATIONS OF FIRST AND SECOND CAMS, FIRST AND SECOND DEVELOPING ROLLERS TOWARD AND AWAY FROM FIRST AND SECOND PHOTOSENSITIVE DRUMS, RESPECTIVELY

CROSS REFERENCE TO RELATED APPLICATION

This application is a by-pass continuation application of International Application No. PCT/JP2018/045628 filed Dec. 12, 2018 claiming priority from Japanese Patent Application No. 2018-067792 filed Mar. 30, 2018. The entire contents of the international application and the priority application are incorporated herein by reference.

TECHNICAL FIELD

The present disclosure relates to an image forming apparatus.

BACKGROUND

A conventional image forming apparatus disclosed in Japanese Patent Application Publication No. 2012-128017 includes a first photosensitive drum, a second photosensitive drum, a first developing unit that includes a first developing roller, a second developing unit that includes a second developing roller, a rotatable first cam, and a rotatable second cam.

The first cam pushes a boss of the first developing unit, whereby the first developing roller is separated from the first photosensitive drum. The second cam pushes a boss of the second developing unit, whereby the second developing roller is separated from the second photosensitive drum. The angle of rotation of the first cam and the angle of rotation of the second cam are offset from each other so as to synchronize with, respectively, the timing when a toner image is transferred from the first photosensitive drum onto a printing medium and the timing when a toner image is transferred from the second photosensitive drum to the printing medium.

SUMMARY

In the image forming apparatus described in Patent Literature 1, however, the first cam pushes the boss of the first developing unit in a direction crossing the rotation axis of the first cam. In addition, the second cam pushes the boss of the second developing unit in a direction crossing the rotation axis of the second cam.

Therefore, the first cam and the second cam each require a shaft having a strength sufficient to withstand the reaction force from the boss, which makes it hard to reduce their sizes.

In view of the foregoing, it is an object of the present disclosure to provide an image forming apparatus in which first and second cams can be reduced in size.

In order to attain the above object, the present disclosure provides an image forming apparatus including: a conveyance belt; a first photosensitive drum; a second photosensitive drum; a first developing roller; a second developing roller; a first rod; a second rod; a first cam; a second cam; a first gear; an idle gear; and a second gear. The conveyance belt is configured to convey a printing medium. The first photosensitive drum is rotatable about a first drum axis extending in a first direction. The second photosensitive drum is rotatable about a second drum axis extending in the first direction. The second photosensitive drum is positioned downstream of the first photosensitive drum in a second direction that is a direction in which the conveyance belt conveys the printing medium. The second photosensitive drum is positioned spaced apart from the first photosensitive drum in the second direction. The first developing roller is rotatable about a first roller axis extending in the first direction. The first developing roller is movable between a first contact position where the first developing roller is in contact with the first photosensitive drum and a first separated position where the first developing roller is separated from the first photosensitive drum. The second developing roller is rotatable about a second roller axis extending in the first direction. The second developing roller is movable between a second contact position where the second developing roller is in contact with the second photosensitive drum and a second separated position where the second developing roller is separated from the second photosensitive drum. The first rod is for moving the first developing roller from the first contact position to the first separated position. The first rod is movable in the first direction between a first advanced position where the first rod places the first developing roller in the first separated position and a first retracted position where the first rod allows the first developing roller to be positioned in the first contact position. The second rod is for moving the second developing roller from the second contact position to the second separated position. The second rod is movable in the first direction between a second advanced position where the second rod places the second developing roller in the second separated position and a second retracted position where the second rod allows the second developing roller to be positioned in the second contact position. The first cam is rotatable about a first axis extending in the first direction. The first cam is configured to, as the first cam rotates, shift between a first pushing state in which the first cam places the first rod in the first advanced position and a first push-released state in which the first cam allows the first rod to be positioned in the first retracted position. The second cam is rotatable about a second axis extending in the first direction. The second cam is configured to, as the second cam rotates, shift between a second pushing state in which the second cam places the second rod in the second advanced position and a second push-released state in which the second cam allows the second rod to be positioned in the second retracted position. The first gear is rotatable about the first axis together with the first cam. The idle gear is meshingly engaged with the first gear. The second gear is rotatable about the second axis together with the second cam. The second gear is meshingly engaged with the idle gear. A rotation angle of the first cam and a rotation angle of the second cam are offset so that the first cam enters the first pushing state after the printing medium separates from the first photosensitive drum and before the second cam enters the second pushing state. The first cam includes a first disk and a first rib. The first disk is rotatable together with the first gear. The first rib is positioned on an opposite side of the first disk from the first gear in the first direction. The first rib projects from the first disk in the first direction. The first rib extends in a circumferential direction of the first disk. The first rib is in contact with the first rod when the first cam is in the first pushing state. The first rib is away from the first rod when the first cam is in the first push-released state. The second cam includes a second disk and a second rib. The second disk is rotatable together with the second gear. The second rib is positioned on an opposite side of the second disk from the second gear in the first direction. The second rib projects from the second disk in the first direction. The second rib extends in a circumferential direction of the second disk. The second rib is in contact with the second rod when the second cam is in the second pushing state. The second rib is away from the second rod when the second cam is in the second push-released state.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
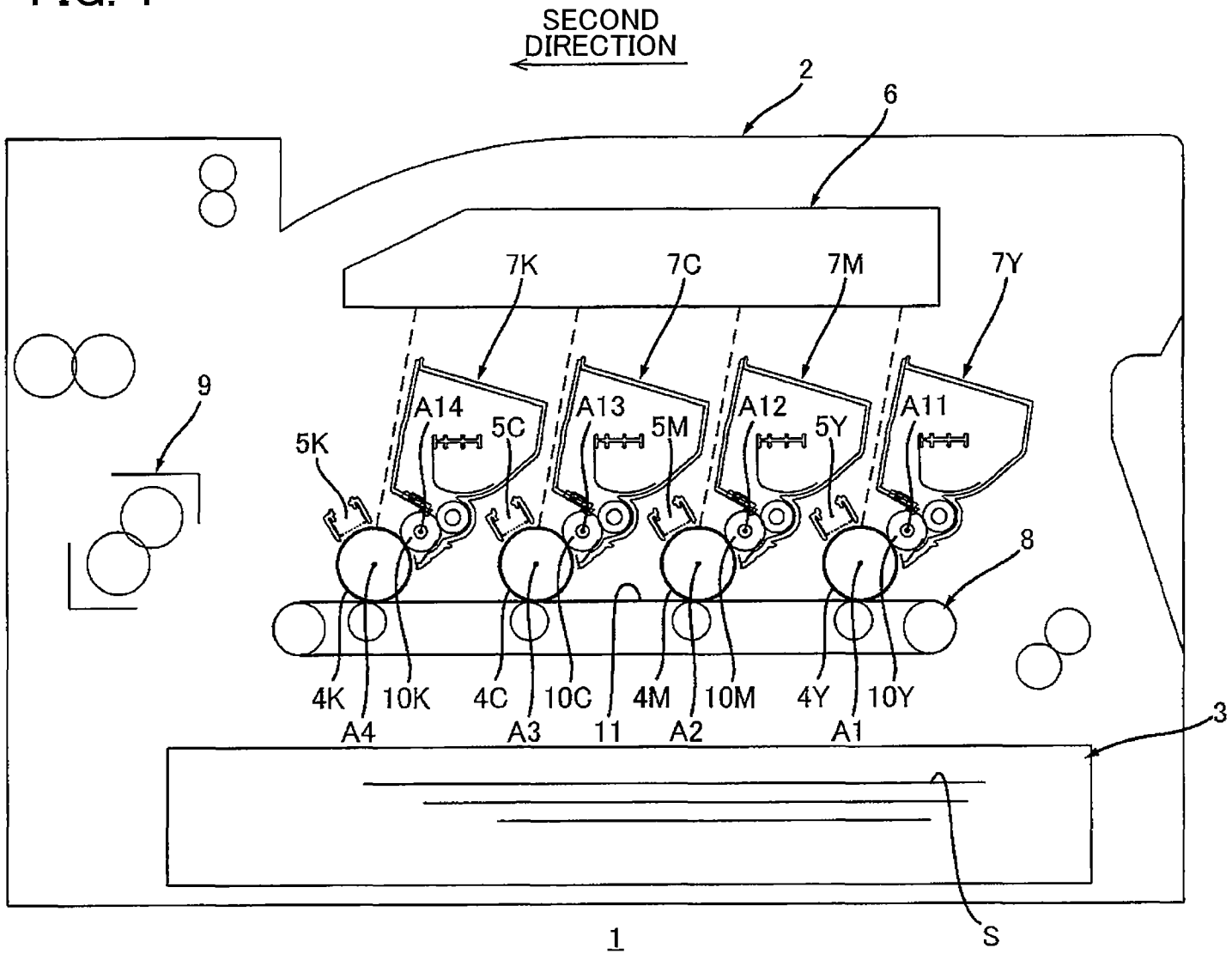
FIG. 1 is a schematic diagram of an image formation apparatus and illustrates a state where four developing rollers are each positioned in their contact positions.

1. Overview of Image Forming Apparatus 1

An overview of an image forming apparatus 1 will be described while referring to FIG. 1.

The image forming apparatus 1 includes a main body casing 2, a sheet supply tray 3, four photosensitive drums 4Y, 4M, 4C, and 4K, four chargers 5Y, 5M, 5C, and 5K, an exposure device 6, four developing units 7Y, 7M, 7C, and 7K, a transfer device 8, and a fixing device 9.

1.1 Main Body Casing

The main body casing 2 constitutes an outer shell of the image forming apparatus 1. The main body casing 2 accommodates therein the sheet supply tray 3, the four photosensitive drums 4Y, 4M, 4C, and 4K, the four chargers 5Y, 5M, 5C, and 5K, the exposure device 6, the four developing units 7Y, 7M, 7C, and 7K, the transfer device 8, and the fixing device 9.

1.2 Sheet Supply Tray

The sheet supply tray 3 accommodates a printing medium S. The printing medium S in the sheet supply tray 3 is conveyed toward the photosensitive drum 4Y. The printing medium S is, for example, a printing paper sheet. The photosensitive drum 4Y will be described later.

1.3 Four Photosensitive Drums

The photosensitive drum 4Y is rotatable about a first drum axis A1. The photosensitive drum 4M is rotatable about a second drum axis A2. The photosensitive drum 4C is rotatable about a third drum axis A3. The photosensitive drum 4K is rotatable about a fourth drum axis A4. The first drum axis A1, the second drum axis A2, the third drum axis A3, and the fourth drum axis A4 each extend in a first direction. The four photosensitive drums 4Y, 4M, 4C, and 4K are arrayed in a second direction. The second direction is a direction in which a conveyance belt 11 conveys the printing medium S. The second direction crosses the first direction. Preferably, the second direction is orthogonal to the first direction. The conveyance belt 11 will be described later. The photosensitive drum 4M is positioned downstream of the photosensitive drum 4Y in the second direction. The photosensitive drum 4C is positioned downstream of the photosensitive drum 4M in the second direction. The photosensitive drum 4K is positioned downstream of the photosensitive drum 4C in the second direction. In other words, the four photosensitive drums 4Y, 4M, 4C, and 4K are arrayed in the second direction in order of the photosensitive drum 4Y, the photosensitive drum 4M, the photosensitive drum 4C, and the photosensitive drum 4K. The photosensitive drum 4M is positioned spaced apart from the photosensitive drum 4Y in the second direction. The photosensitive drum 4C is positioned spaced apart from the photosensitive drum 4M in the second direction. The photosensitive drum 4K is positioned spaced apart from the photosensitive drum 4C in the second direction.

The four photosensitive drums 4Y, 4M, 4C, and 4K each have a cylindrical shape extending in the first direction.

1.4 Four Chargers

The charger 5Y is configured to charge a peripheral surface of the photosensitive drum 4Y. The charger 5M is configured to charge a peripheral surface of the photosensitive drum 4M. The charger 5C is configured to charge a peripheral surface of the photosensitive drum 4C. The charger 5K is configured to charge a peripheral surface of the photosensitive drum 4K. Specifically, the four chargers 5Y, 5M, 5C, and 5K are each a scorotron charger. Alternatively, the four chargers 5Y, 5M, 5C, and 5K may each be a charging roller.

1.5 Exposure Device

The exposure device 6 is configured to expose the photosensitive drum 4Y. After the charger 5Y has charged the peripheral surface of the photosensitive drum 4Y, the exposure device 6 irradiates the charged peripheral surface of the photosensitive drum 4Y with light to expose the peripheral surface, thereby forming an electrostatic latent image on the peripheral surface of the photosensitive drum 4Y. Specifically, the exposure device 6 is a laser scan unit configured to scan the peripheral surface of the photosensitive drum 4Y with a laser beam. Alternatively, the exposure device 6 may be an LED unit that includes an LED array. The exposure device 6 is configured to expose the photosensitive drums 4M, 4C, and 4K as well.

1.6 Four Developing Units

Each of the four developing units 7Y, 7M, 7C, and 7K can accommodate therein toner. The four developing units 7Y, 7M, 7C, and 7K are arrayed in the second direction. The developing unit 7Y includes a developing roller 10Y. The developing unit 7M includes a developing roller 10M. The developing unit 7C includes a developing roller 10C. The developing unit 7K includes a developing roller 10K. In other words, the image forming apparatus 1 includes the four developing rollers 10Y, 10M, 10C, and 10K.

The developing roller 10Y is rotatable about a first roller axis A11. The developing roller 10M is rotatable about a second roller axis A12. The developing roller 10C is rotatable about a third roller axis A13. The developing roller 10K is rotatable about a fourth roller axis A14. The first roller axis A11, the second roller axis A12, the third roller axis A13, and the fourth roller axis A14 each extend in the first direction.

The developing roller 10Y is configured to contact the peripheral surface of the photosensitive drum 4Y. The developing roller 10Y can supply the toner in the developing unit 7Y to the peripheral surface of the photosensitive drum 4Y. The developing roller 10M is configured to contact the peripheral surface of the photosensitive drum 4M. The developing roller 10M can supply the toner in the developing unit 7M to the peripheral surface of the photosensitive drum 4M. The developing roller 10C is configured to contact the peripheral surface of the photosensitive drum 4C. The developing roller 10C can supply the toner in the developing unit 7C to the peripheral surface of the photosensitive drum 4C. The developing roller 10K is configured to contact the peripheral surface of the photosensitive drum 4K. The developing roller 10K can supply the toner in the developing unit 7K to the peripheral surface of the photosensitive drum 4K.

Each of the four developing rollers 10Y, 10M, 10C, and 10K extends in the first direction and has a columnar shape.

Figure 2:
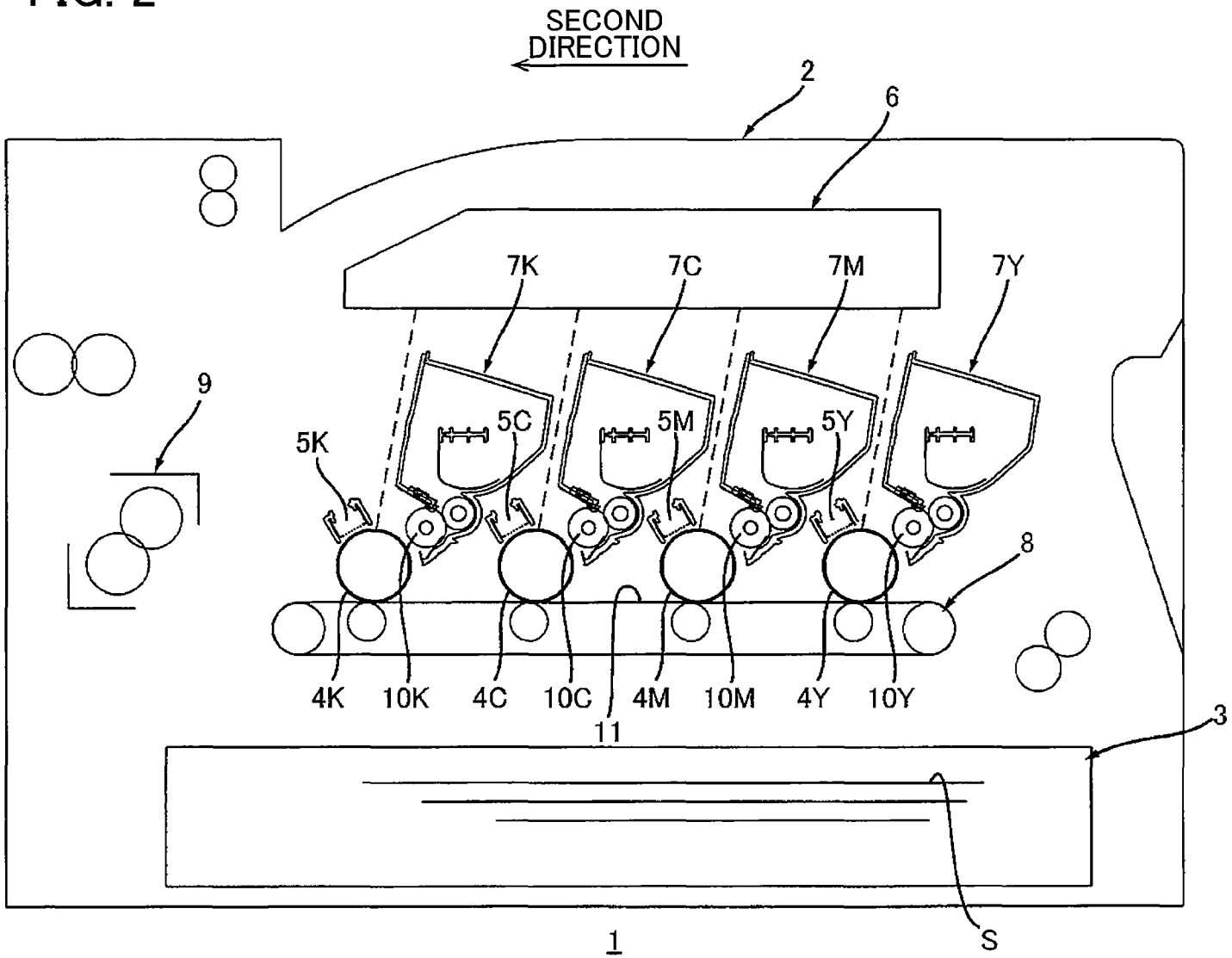
FIG. 2 is a schematic diagram of the image formation apparatus illustrated in FIG. 1 and illustrates a state where the four developing rollers are each positioned at their separated positions.

As illustrated in FIGS. 1 and 2, the developing roller 10Y is movable between a first contact position (see FIG. 1) and a first separated position (see FIG. 2). The developing roller 10Y is in contact with the photosensitive drum 4Y in a state where the developing roller 10Y is in the first contact position. The developing roller 10Y is separated from the photosensitive drum 4Y in a state where the developing roller 10Y is in the first separated position.

The developing roller 10M is movable between a second contact position (see FIG. 1) and a second separated position (see FIG. 2). The developing roller 10M is in contact with the photosensitive drum 4M in a state where the developing roller 10M is in the second contact position. The developing roller 10M is separated from the photosensitive drum 4M in a state where the developing roller 10M is in the second separated position.

The developing roller 10C is movable between a third contact position (see FIG. 1) and a third separated position (see FIG. 2). The developing roller 10C is in contact with the photosensitive drum 4C in a state where the developing roller 10C is in the third contact position. The developing roller 10C is separated from the photosensitive drum 4C in a state where the developing roller 10C is in the third separated position.

The developing roller 10K is movable between a fourth contact position (see FIG. 1) and a fourth separated position (see FIG. 2). The developing roller 10K is in contact with the photosensitive drum 4K in a state where the developing roller 10K is in the fourth contact position. The developing roller 10K is separated from the photosensitive drum 4K in a state where the developing roller 10K is in the fourth separated position.

1.7 Transfer Device

As illustrated in FIG. 1, the transfer device 8 includes the conveyance belt 11. In other words, the image forming apparatus 1 includes the conveyance belt 11. The conveyance belt 11 is configured to convey the printing medium S. Specifically, the conveyance belt 11 is configured to convey the printing medium S supplied from the sheet supply tray 3 toward the fixing device 9. The printing medium S conveyed by the conveyance belt 11 passes through the portions between the transfer device 8 and the four photosensitive drums 4Y, 4M, 4C, and 4K. At this point, the transfer device 8 transfers toner images formed on the four respective photosensitive drums 4Y, 4M, 4C, and 4K onto the printing medium S.

1.8 Fixing Device

The fixing device 9 is configured to apply heat and pressure to the printing medium S having the toner images transferred thereon to thereby fix the toner images onto the printing medium S. The printing medium S that has passed through the fixing device 9 is discharged to the upper surface of the main body casing 2.

2. Details of Image Forming Apparatus

Next, the image forming apparatus 1 will be described in detail while referring to FIGS. 3 to 7.

Figure 3:
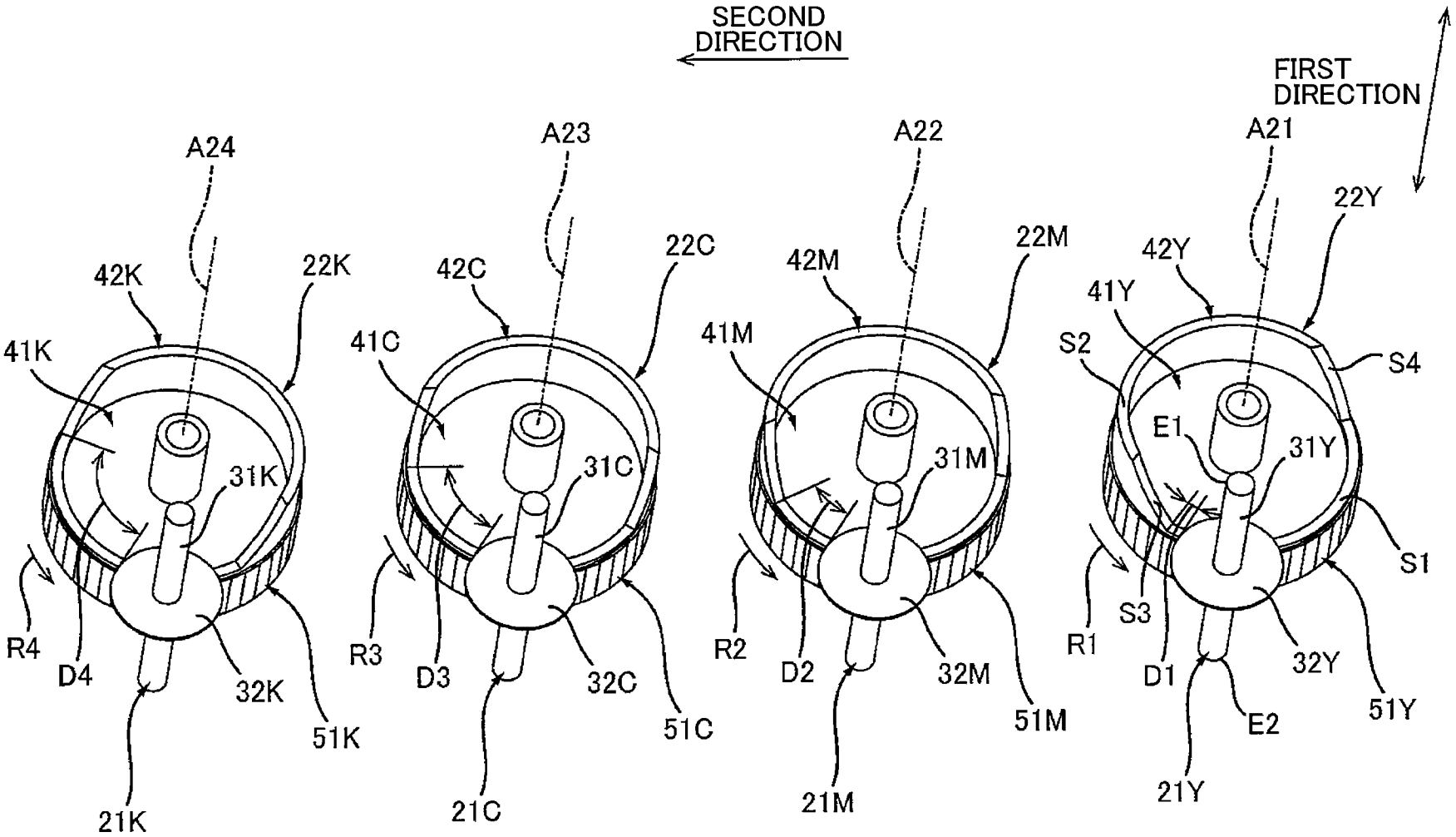
FIG. 3 is a perspective view of four rods and four cams for moving the four developing rollers illustrated in FIG. 1 from their contact positions to their separated positions and illustrates a state where the four cams are each positioned at their push-released positions and the four rods are each positioned at their retracted positions.
Figure 7:
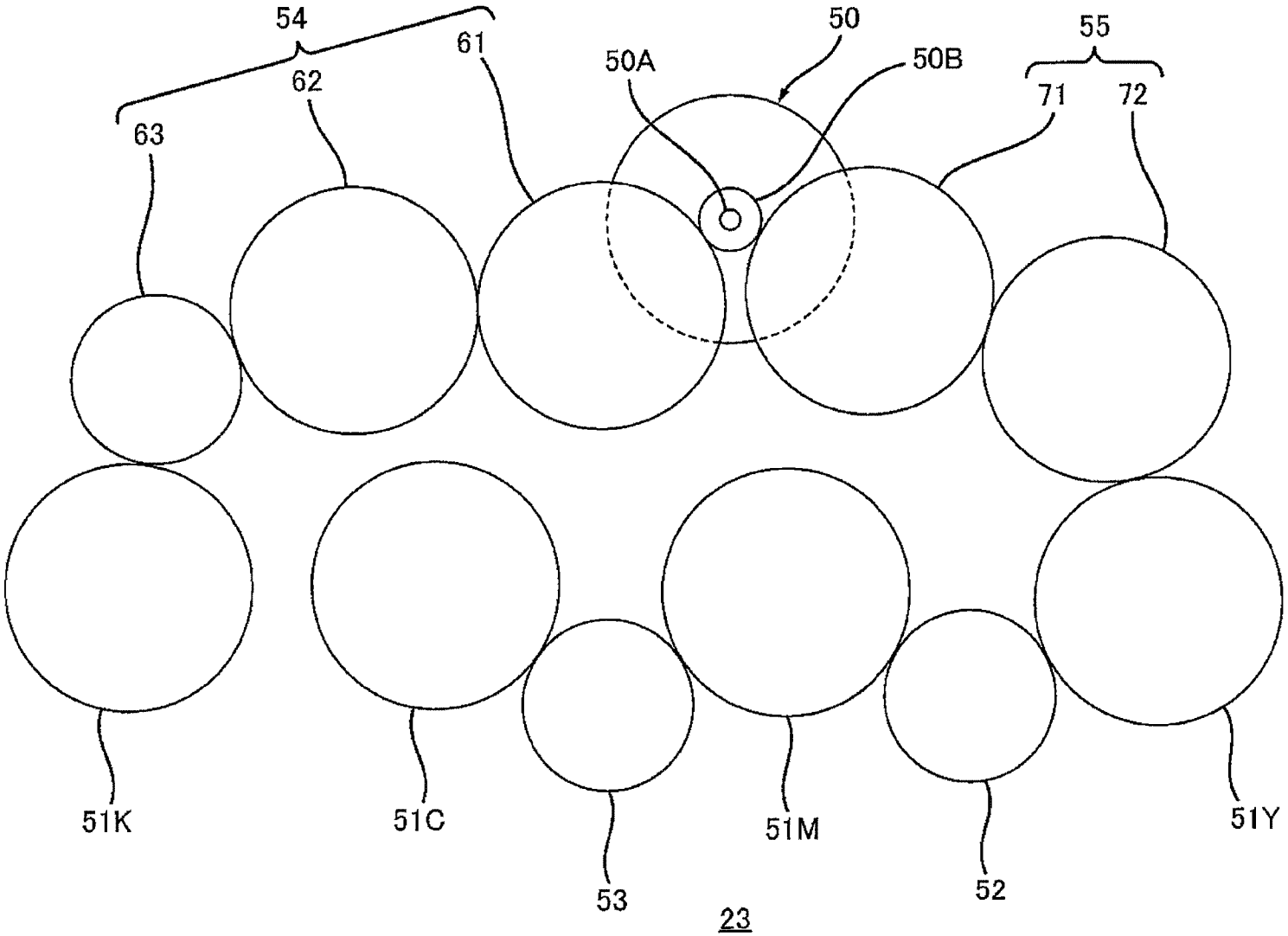
FIG. 7 is an explanation view for explaining gear trains for transmits motive power to the four cams illustrated in FIG. 3.

As illustrated in FIGS. 3 and 7, the image forming apparatus 1 includes a first rod 21Y, a second rod 21M, a third rod 21C, a fourth rod 21K, a first cam 22Y, a second cam 22M, a third cam 22C, a fourth cam 22K, a motor 50 (see FIG. 7), and a gear train 23 (see FIG. 7).

2.1 First Rod

Figure 4:
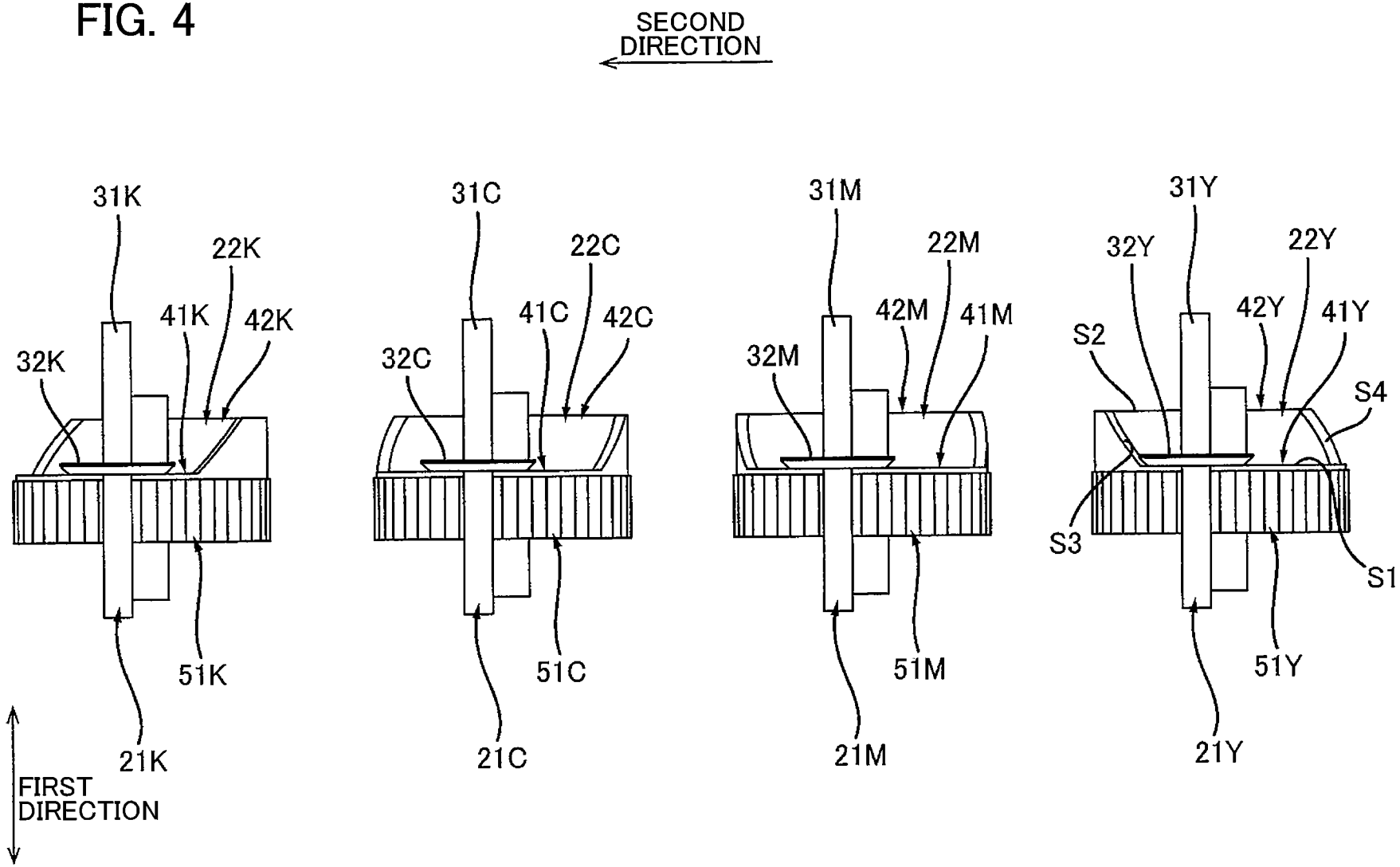
FIG. 4 is a side view of the four rods and four cams illustrated in FIG. 3.
Figure 6:
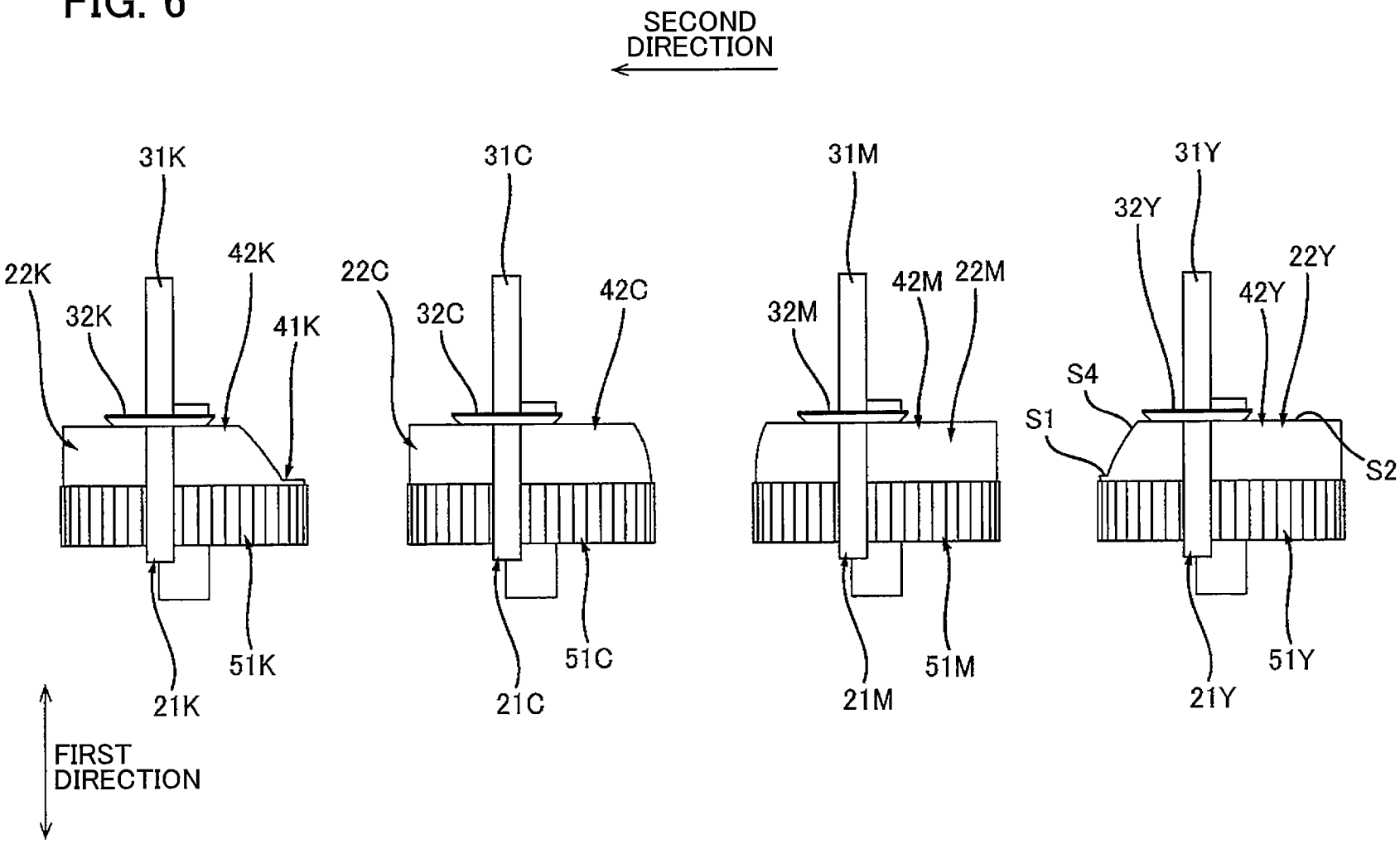
FIG. 6 is a side view of the four rods and four cams illustrated in FIG. 5.

As illustrated in FIGS. 4 and 6, the first rod 21Y is movable in the first direction between a first advanced position (see FIG. 6) and a first retracted position (see FIG. 4). The first rod 21Y places the developing roller 10Y in the first separated position (see FIG. 2) in a state where the first rod 21Y is in the first advanced position. The first rod 21Y allows the developing roller 10Y to be positioned in the first contact position (see FIG. 1) in a state where the first rod 21Y is in the first retracted position. The movement of the first rod 21Y from the first retracted position to the first advanced position moves the developing roller 10Y from the first contact position to the first separated position. The movement of the first rod 21Y from the first advanced position to the first retracted position allows the developing roller 10Y to move from the first separated position to the first contact position.

As illustrated in FIG. 3, the first rod 21Y includes a first rod main body 31Y and a first projection portion 32Y.

The first rod main body 31Y extends in the first direction. The first rod main body 31Y has a columnar shape. The first rod main body 31Y has one end E1 and another end E2 in the first direction. The other end E2 is positioned away from the one end E1 in the first direction.

The first projection portion 32Y is positioned between the one end E1 and the other end E2 in the first direction. The first projection portion 32Y projects from a peripheral surface of the first rod main body 31Y in a direction crossing the first direction. Preferably, the first projection portion 32Y projects from the peripheral surface of the first rod main body 31Y in a direction orthogonal to the first direction. The first projection portion 32Y extends in a circumferential direction of the first rod main body 31Y. The first projection portion 32Y can come into contact with a first rib 42Y of the first cam 22Y when the first cam 22Y rotates. The first rib 42Y will be described later.

2.2 Second Rod

As illustrated in FIGS. 4 and 6, the second rod 21M is movable in the first direction between a second advanced position (see FIG. 6) and a second retracted position (see FIG. 4). The second rod 21M places the developing roller 10M in the second separated position (see FIG. 2) in a state where the second rod 21M is in the second advanced position. The second rod 21M allows the developing roller 10M to be positioned in the second contact position (see FIG. 1) in a state where the second rod 21M is in the second retracted position. The movement of the second rod 21M from the second retracted position to the second advanced position moves the developing roller 10M from the second contact position to the second separated position. The movement of the second rod 21M from the second advanced position to the second retracted position allows the developing roller 10M to move from the second separated position to the second contact position.

As illustrated in FIG. 3, the second rod 21M includes a second rod main body 31M and a second projection portion 32M. The structure of the second rod 21M is identical to that of the first rod 21Y, and the description on the structure of the first rod 21Y can be applied to that of the second rod 21M. Specifically, the second rod main body 31M extends in the first direction. The second projection portion 32M projects from a peripheral surface of the second rod main body 31M in a direction crossing the first direction. The description on the structure of the second rod 21M will be omitted.

2.3 Third Rod

As illustrated in FIGS. 4 and 6, the third rod 21C is movable in the first direction between a third advanced position (see FIG. 6) and a third retracted position (see FIG. 4). The third rod 21C places the developing roller 10C in the third separated position (see FIG. 2) in a state where the third rod 21C is in the third advanced position. The third rod 21C allows the developing roller 10C to be positioned in the third contact position (see FIG. 1) in a state where the third rod 21C is in the third retracted position. The movement of the third rod 21C from the third retracted position to the third advanced position moves the developing roller 10C from the third contact position to the third separated position. The movement of the third rod 21C from the third advanced position to the third retracted position allows the developing roller 10C to move from the third separated position to the third contact position.

As illustrated in FIG. 3, the third rod 21C includes a third rod main body 31C and a third projection portion 32C. The structure of the third rod 21C is identical to that of the first rod 21Y, and the description on the structure of the first rod 21Y can be applied to that of the third rod 21C. Specifically, the third rod main body 31C extends in the first direction. The third projection portion 32C projects from a peripheral surface of the third rod main body 31C in a direction crossing the first direction. The description on the structure of the third rod 21C will be omitted.

2.4 Fourth Rod

As illustrated in FIGS. 4 and 6, the fourth rod 21K is movable in the first direction between a fourth advanced position (see FIG. 6) and a fourth retracted position (see FIG. 4). The fourth rod 21K places the developing roller 10K in the fourth separated position (see FIG. 2) in a state where the fourth rod 21K is in the fourth advanced position. The fourth rod 21K allows the developing roller 10K to be positioned in the fourth contact position (see FIG. 1) in a state where the fourth rod 21K is in the fourth retracted position. The movement of the fourth rod 21K from the fourth retracted position to the fourth advanced position moves the developing roller 10K from the fourth contact position to the fourth separated position. The movement of the fourth rod 21K from the fourth advanced position to the fourth retracted position allows the developing roller 10K to move from the fourth separated position to the fourth contact position.

As illustrated in FIG. 3, the fourth rod 21K includes a fourth rod main body 31K and a fourth projection portion 32K. The structure of the fourth rod 21K is identical to that of the first rod 21Y, and the description on the structure of the first rod 21Y can be applied to that of the fourth rod 21K. Specifically, the fourth rod main body 31K extends in the first direction. The fourth projection portion 32K projects from a peripheral surface of the fourth rod main body 31K in a direction crossing with the first direction. The description on the structure of the fourth rod 21K will be omitted.

2.5 First Cam

The first cam 22Y is rotatable about a first axis A21. The first axis A21 extends in the first direction. As the first cam 22Y rotates, the first cam 22Y shifts between a first pushing state (see FIG. 5) and a first push-released state (see FIG. 3). The first cam 22Y places the first rod 21Y in the first advanced position when the first cam 22Y is in the first pushing state. The first cam 22Y allows the first rod 21Y to be positioned in the first retracted position when the first cam 22Y is in the first push-released state.

The first cam 22Y includes a first disk 41Y and the first rib 42Y.

The first disk 41Y extends in a direction crossing the first axis A21. The first disk 41Y is rotatable about the first axis A21. The first disk 41Y is rotatable together with a first gear 51Y. The first gear 51Y will be described later. The first disk 41Y has a first flat surface S1.

As illustrated in FIG. 3, when the first cam 22Y is in the first push-released state, the first flat surface S1 faces, in the first direction, the first projection portion 32Y of the first rod 21Y that is in the first retracted position. When the first cam 22Y is in the first push-released state, the first flat surface S1 may be in contact with the first projection portion 32Y of the first rod 21Y that is in the first retracted position. The first flat surface S1 extends in a direction crossing the first axis A21. Preferably, the first flat surface S1 extends in a direction orthogonal to the first axis A21.

The first rib 42Y is positioned on the opposite side of the first disk 41Y from the first gear 51Y in the first direction. The first rib 42Y projects from the first disk 41Y in the first direction. The first rib 42Y extends in a circumferential direction of the first disk 41Y. The first rib 42Y has a second flat surface S2, a first inclined surface S3, and a second inclined surface S4.

Figure 5:
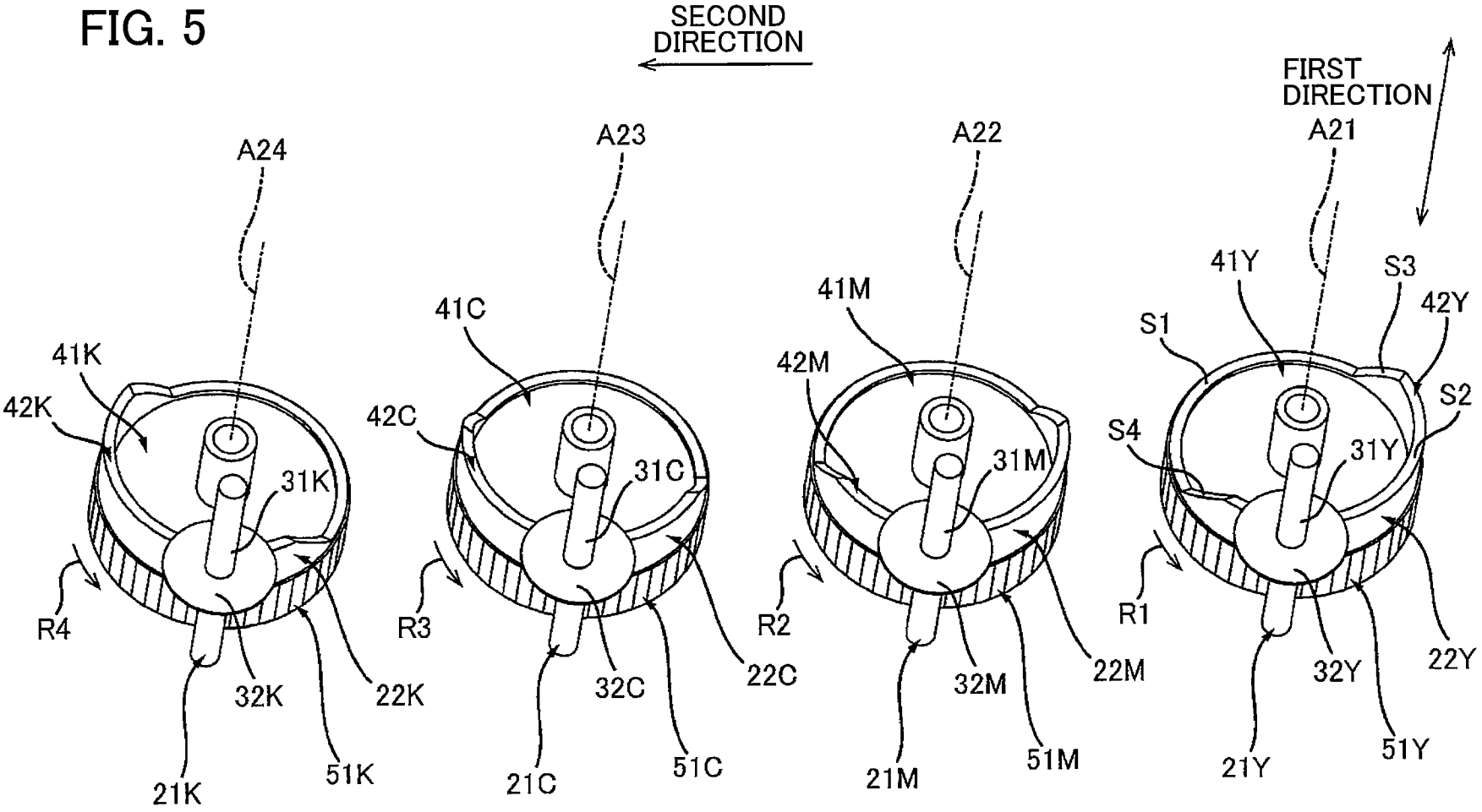
FIG. 5 illustrates a state where the four cams illustrated in FIG. 3 are each positioned at their pushing positions and the four rods are each positioned at their advanced positions.

As illustrated in FIG. 5, when the first cam 22Y is in the first pushing state, the second flat surface S2 is in contact, in the first direction, with the first projection portion 32Y of the first rod 21Y that is in the first advanced position. In other words, when the first cam 22Y is in the first pushing state, the first rib 42Y is in contact with the first projection portion 32Y of the first rod 21Y. With this configuration, when the first cam 22Y is in the first pushing state, the first cam 22Y pushes the first projection portion 32Y with the first rib 42Y to thereby place the first rod 21Y in the first advanced position. On the other hand, when the first cam 22Y is in the first push-released state, the first rib 42Y is away from the first projection portion 32Y of the first rod 21Y. With this configuration, when the first cam 22Y is in the first push-released state, the first cam 22Y does not push the first projection portion 32Y with the first rib 42Y and allows the first rod 21Y to be positioned in the first retracted position. The second flat surface S2 and the first flat surface S1 are positioned in different positions in the first direction. The second flat surface S2 and the first flat surface S1 are positioned spaced apart from each other in the first direction. The second flat surface S2 extends in a direction crossing the first axis A21. Preferably, the second flat surface S2 extends in a direction orthogonal to the first axis A21. The second flat surface S2 and the first flat surface S1 are parallel to each other.

The first inclined surface S3 illustrated in FIG. 3 contacts the first projection portion 32Y of the first rod 21Y in a process in which the first cam 22Y shifts from the first push-released state (see FIG. 3) to the first pushing state (see FIG. 5). The first inclined surface S3 is positioned between the first flat surface S1 and the second flat surface S2. The first inclined surface S3 is inclined relative to the first flat surface S1 and the second flat surface S2. The first inclined surface S3 connects the first flat surface S1 and the second flat surface S2. In the process in which the first cam 22Y shifts from the first push-released state to the first pushing state, the first projection portion 32Y slides on the first inclined surface S3 as the first cam 22Y rotates, so that the first rod 21Y moves from the first retracted position to the first advanced position.

The second inclined surface S4 illustrated in FIG. 5 contacts the first projection portion 32Y of the first rod 21Y in a process in which the first cam 22Y shifts from the first pushing state (see FIG. 5) to the first push-released state (see FIG. 3). The second inclined surface S4 is positioned between the first flat surface S1 and the second flat surface S2. The second inclined surface S4 is positioned on the opposite side of the first axis A21 from the first inclined surface S3 in the radial direction of the first disk 41Y. The second inclined surface S4 is inclined relative to the first flat surface S1 and the second flat surface S2. The second inclined surface S4 connects the first flat surface S1 and the second flat surface S2. In the process in which the first cam 22Y shifts from the first pushing state to the first push-released state, the first projection portion 32Y slides on the second inclined surface S4 as the first cam 22Y rotates, so that the first rod 21Y moves from the first advanced position to the first retracted position.

2.6 Second Cam

As illustrated in FIG. 3, the second cam 22M is rotatable about a second axis A22. The second axis A22 extends in the first direction. As the second cam 22M rotates, the second cam 22M shifts between a second pushing state (see FIG. 5) and a second push-released state (see FIG. 3). The second cam 22M places the second rod 21M in the second advanced position when the second cam 22M is in the second pushing state. The second cam 22M allows the second rod 21M to be positioned in the second retracted position when the second cam 22M is in the second push-released state.

The second cam 22M includes a second disk 41M and a second rib 42M.

The second disk 41M extends in a direction crossing the second axis A22. The second disk 41M is rotatable about the second axis A22. The second disk 41M is rotatable together with a second gear 51M. The second gear 51M will be described later. The structure of the second disk 41M is identical to that of the first disk 41Y, and the description on the structure of the first disk 41Y can be applied to that of the second disk 41M. The description on the structure of the second disk 41M will be omitted.

The second rib 42M is positioned on the opposite side of the second disk 41M from the second gear 51M in the first direction. The second rib 42M projects from the second disk 41M in the first direction. The second rib 42M extends in a circumferential direction of the second disk 41M. The second rib 42M is in contact with the second projection portion 32M of the second rod 21M when the second cam 22M is in the second pushing state. With this configuration, when the second cam 22M is in the second pushing state, the second cam 22M pushes the second projection portion 32M with the second rib 42M to place the second rod 21M in the second advanced position. On the other hand, when the second cam 22M is in the second push-released state, the second rib 42M is away from the second projection portion 32M of the second rod 21M. With this configuration, when the second cam 22M is in the second push-released state, the second cam 22M does not push the second projection portion 32M with the second rib 42M and allows the second rod 21M to be positioned in the second retracted position. The structure of the second rib 42M is identical to that of the first rib 42Y, and the description on the structure of the first rib 42Y can be applied to that of the second rib 42M. The description on the structure of the second rib 42M will be omitted.

2.7 Third Cam

As illustrated in FIG. 3, the third cam 22C is rotatable about a third axis A23. The third axis A23 extends in the first direction. As the third cam 22C rotates, the third cam 22C shifts between a third pushing state (see FIG. 5) and a third push-released state (see FIG. 3). The third cam 22C places the third rod 21C in the third advanced position when the third cam 22C is in the third pushing state. The third cam 22C allows the third rod 21C to be positioned in the third retracted position when the third cam 22C is in the third push-released state.

The third cam 22C includes a third disk 41C and a third rib 42C.

The third disk 41C extends in a direction crossing the third axis A23. The third disk 41C is rotatable about the third axis A23. The third disk 41C is rotatable together with a third gear 51C. The third gear 51C will be described later. The structure of the third disk 41C is identical to that of the first disk 41Y, and the description on the structure of the first disk 41Y can be applied to that of the third disk 41C. Therefore, the description on the structure of the third disk 41C will be omitted.

The third rib 42C is positioned on the opposite side of the third disk 41C from the third gear 51C in the first direction. The third rib 42C projects from the third disk 41C in the first direction. The third rib 42C extends in a circumferential direction of the third disk 41C. The third rib 42C is in contact with the third projection portion 32C of the third rod 21C when the third cam 22C is in the third pushing state. With this configuration, when the third cam 22C is in the third pushing state, the third cam 22C pushes the third projection portion 32C with the third rib 42C to place the third rod 21C in the third advanced position. On the other hand, when the third cam 22C is in the third push-released state, the third rib 42C is away from the third projection portion 32C of the third rod 21C. With this configuration, when the third cam 22C is in the third push-released state, the third cam 22C does not push the third projection portion 32C with the third rib 42C and allows the third rod 21C to be positioned in the third retracted position. The structure of the third rib 42C is identical to that of the first rib 42Y, and the description on the structure of the first rib 42Y can be applied to that of the third rib 42C. The description on the structure of the third rib 42C will be omitted.

2.8 Fourth Cam

As illustrated in FIG. 3, the fourth cam 22K is rotatable about a fourth axis A24. The fourth axis A24 extends in the first direction. As the fourth cam 22K rotates, the fourth cam 22K shifts between a fourth pushing state (see FIG. 5) and a fourth push-released state (see FIG. 3). The fourth cam 22K places the fourth rod 21K in the fourth advanced position when the fourth cam 22K is in the fourth pushing state. The fourth cam 22K allows the fourth rod 21K to be positioned in the fourth retracted position when the fourth cam 22K is in the fourth push-released state.

The fourth cam 22K includes a fourth disk 41K and a fourth rib 42K.

The fourth disk 41K extends in a direction crossing the fourth axis A24. The fourth disk 41K is rotatable about the fourth axis A24. The fourth disk 41K is rotatable together with a fourth gear 51K. The fourth gear 51K will be described later. The structure of the fourth disk 41K is identical to that of the first disk 41Y, and the description on the structure of the first disk 41Y can be applied to that of the fourth disk 41K. Therefore, the description on the structure of the fourth disk 41K will be omitted.

The fourth rib 42K is positioned on the opposite side of the fourth disk 41K from the fourth gear 51K in the first direction. The fourth rib 42K projects from the fourth disk 41K in the first direction. The fourth rib 42K extends in a circumferential direction of the fourth disk 41K. The fourth rib 42K is in contact with the fourth projection portion 32K of the fourth rod 21K when the fourth cam 22K is in the fourth pushing state. With this configuration, when the fourth cam 22K is in the fourth pushing state, the fourth cam 22K pushes the fourth projection portion 32K with the fourth rib 42K to place the fourth rod 21K in the fourth advanced position. On the other hand, when the fourth cam 22K is in the fourth push-released state, the fourth rib 42K is away from the fourth projection portion 32K of the fourth rod 21K. With this configuration, when the fourth cam 22K is in the fourth push-released state, the fourth cam 22K does not push the fourth projection portion 32K with the fourth rib 42K and allows the fourth rod 21K to be positioned in the fourth retracted position. The structure of the fourth rib 42K is identical to that of the first rib 42Y, and the description on the structure of the first rib 42Y can be applied to that of the fourth rib 42K. The description on the structure of the fourth rib 42K will be omitted.

2.9 Regarding Angle of Rotation of Cam

As illustrated in FIG. 3, the rotation angle of the first cam 22Y and the rotation angle of the second cam 22M are offset from each other so that the first cam 22Y will enter the first pushing state after the printing medium S has separated from the photosensitive drum 4Y (see FIG. 1) and before the second cam 22M enters the second pushing state. The rotation angle of the second cam 22M and the rotation angle of the third cam 22C are offset from each other so that the second cam 22M will enter the second pushing state after the printing medium S has separated from the photosensitive drum 4M (see FIG. 1) and before the third cam 22C enters the third pushing state. The rotation angle of the third cam 22C and the rotation angle of the fourth cam 22K are offset from each other so that the third cam 22C will enter the third pushing state after the printing medium S has separated from the photosensitive drum 4C (see FIG. 1) and before the fourth cam 22K enters the fourth pushing state.

Specifically, at the time point illustrated in FIG. 3, a distance D2 in a direction R2 between the second rib 42M and the second projection portion 32M is greater than a distance D1 in a direction R1 between the first rib 42Y and the first projection portion 32Y. A distance D3 in a direction R3 between the third rib 42C and the third projection portion 32C is greater than the distance D2. A distance D4 in a direction R4 between the fourth rib 42K and the fourth projection portion 32K is greater than the distance D3.

Note that the time point illustrated in FIG. 3 is a time point at which the first cam 22Y is in the first push-released state, the second cam 22M is in the second push-released state, the third cam 22C is in the third push-released state, and the fourth cam 22K is in the fourth push-released state. The direction R1 is a direction in which the first rib 42Y approaches the first projection portion 32Y when the first cam 22Y rotates. The direction R2 is a direction in which the second rib 42M approaches the second projection portion 32M when the second cam 22M rotates. The direction R3 is a direction in which the third rib 42C approaches the third projection portion 32C when the third cam 22C rotates. The direction R4 is a direction in which the fourth rib 42K approaches the fourth projection portion 32K when the fourth cam 22K rotates.

When the first cam 22Y, the second cam 22M, the third cam 22C, and the fourth cam 22K start rotating at the same timing, the first cam 22Y enters the first pushing state, the second cam 22M next enters the second pushing state, the third cam 22C next enters the third pushing state, and the fourth cam 22K next enters the fourth pushing state. In other words, the first cam 22Y enters the first pushing state before the second cam 22M enters the second pushing state, and the second cam 22M enters the second pushing state before the third cam 22C enters the third pushing state.

2.10 Motor

The motor 50, which is illustrated in FIG. 7, is provided inside the main body casing 2. The motor 50 includes an output shaft 50A and an output gear 50B. The output shaft 50A extends in the first direction. The output shaft 50A is rotatable about an axis that extends in the first direction. The output gear 50B is mounted to the output shaft 50A. The output gear 50B is rotatable together with the output shaft 50A.

2.11 Gear Train

As illustrated in FIG. 7, the gear train 23 includes the first gear 51Y, the second gear 51M, the third gear 51C, the fourth gear 51K, an idle gear 52, a second idle gear 53, a first gear train 54, and a second gear train 55.

The first gear 51Y is rotatable together with the first cam 22Y (see FIG. 3) about the first axis A21. The second gear 51M is rotatable together with the second cam 22M (see FIG. 3) about the second axis A22. The third gear 51C is rotatable together with the third cam 22C (see FIG. 3) about the third axis A23. The fourth gear 51K is rotatable together with the fourth cam 22K (see FIG. 3) about the fourth axis A24. The first gear 51Y, the second gear 51M, the third gear 51C, and the fourth gear 51K are positioned spaced apart from one another. The idle gear 52 is meshingly engaged with both the first gear 51Y and the second gear 51M. The second idle gear 53 is meshingly engaged with both the second gear 51M and the third gear 51C.

The first gear train 54 connects the motor 50 and the fourth gear 51K. Specifically, the first gear train 54 includes an idle gear 61, a first electromagnetic clutch 62, and an idle gear 63. The idle gear 61 is meshingly engaged with the output gear 50B, whereby the first gear train 54 is connected to the motor 50. The idle gear 63 is meshingly engaged with the fourth gear 51K, whereby the first gear train 54 is connected to the fourth gear 51K. The first electromagnetic clutch 62 is interposed between the idle gear 61 and the idle gear 63. The first electromagnetic clutch 62 is switchable between an ON-state and an OFF-state. When the first electromagnetic clutch 62 is in the ON-state, the first electromagnetic clutch 62 can transmit a motive power from the idle gear 61 to the idle gear 63. Thus, when the first electromagnetic clutch 62 is in the ON-state, the first electromagnetic clutch 62 transmits a motive power from the motor 50 to the fourth gear 51K. When the first electromagnetic clutch 62 is in the OFF-state, the first electromagnetic clutch 62 disengages the power transmission from the idle gear 61 to the idle gear 63. Thus, when the first electromagnetic clutch 62 is in the OFF-state, the first electromagnetic clutch 62 disengages the power transmission from the motor 50 to the fourth gear 51K.

The second gear train 55 connects the motor 50 and the first gear 51Y. Specifically, the second gear train 55 includes an idle gear 71 and a second electromagnetic clutch 72. The idle gear 71 is meshingly engaged with the output gear 50B, whereby the second gear train 55 is connected to the motor 50. The second electromagnetic clutch 72 is interposed between the idle gear 71 and the first gear 51Y, whereby the second gear train 55 is connected to the first gear 51Y. The second electromagnetic clutch 72 is switchable between an ON-state and an OFF-state. When the second electromagnetic clutch 72 is in the ON-state, the second electromagnetic clutch 72 can transmit a motive power from the idle gear 71 to the first gear 51Y. Thus, when the second electromagnetic clutch 72 is in the ON-state, the second electromagnetic clutch 72 transmits a motive power from the motor 50 to the first gear 51Y. When the second electromagnetic clutch 72 is in the OFF-state, the second electromagnetic clutch 72 disengages the power transmission from the idle gear 71 to the first gear 51Y. Thus, when the second electromagnetic clutch 72 is in the OFF-state, the second electromagnetic clutch 72 disengages the power transmission from the motor 50 to the first gear 51Y.

None of the gears in the second gear train 55 is meshingly engaged with the gears in the first gear train 54. In other words, the second gear train 55 is independent of the first gear train 54.

The first gear train 54 and the second gear train 55 are independent of each other, and the first gear train 54 and the second gear train 55 each include an electromagnetic clutch. This configuration enables the fourth cam 22K to rotate independently of the first cam 22Y, the second cam 22M, and the third cam 22C.

With this configuration, a single-color image formation in which the developing roller 10K is used but the developing rollers 10Y, 10M, and 10C are not used and a multi-color image formation in which all the developing rollers 10Y, 10M, 10C, and 10K are used can switched therebetween.

3. Operation of Image Forming Apparatus

Next, the operation of the image forming apparatus 1 will be described while referring to FIGS. 1 to 3.

As illustrated in FIG. 1, when the image forming apparatus 1 prints on a printing medium S, the conveyance belt 11 conveys the printing medium S supplied from the sheet supply tray 3 toward the fixing device 9 via a route between the transfer device 8 and the four photosensitive drums 4Y, 4M, 4C, and 4K.

At this point, the printing medium S conveyed by the conveyance belt 11 contacts the photosensitive drum 4M after contacting the photosensitive drum 4Y, contacts the photosensitive drum 4C after contacting the photosensitive drum 4M, and contacts the photosensitive drum 4K after contacting the photosensitive drum 4C because the four photosensitive drums 4Y, 4M, 4C, and 4K are arrayed in the second direction in order of the photosensitive drum 4Y, the photosensitive drum 4M, the photosensitive drum 4C, and the photosensitive drum 4K. In addition, the printing medium S separates from the photosensitive drum 4M after separating from the photosensitive drum 4Y, separates from the photosensitive drum 4C after separating from the photosensitive drum 4M, and separates from the photosensitive drum 4K after separating from the photosensitive drum 4C.

Then, in the image forming apparatus 1, each of the first electromagnetic clutch 62 and the second electromagnetic clutch 72 is switched from its OFF-state to its ON-state at a timing so that the first cam 22Y will enter the first pushing state after the printing medium S has separated from the photosensitive drum 4Y.

This causes the first cam 22Y, the second cam 22M, the third cam 22C, and the fourth cam 22K to start rotating at the same timing from the state in which their rotation angles are offset from each other (see FIG. 3). Thus, the first cam 22Y enters the first pushing state after the printing medium S has separated from the photosensitive drum 4Y. Next, the second cam 22M enters the second pushing state after the printing medium S has separated from the photosensitive drum 4M. Next, the third cam 22C enters the third pushing state after the printing medium S has separated from the photosensitive drum 4C. Next, the fourth cam 22K enters the fourth pushing state after the printing medium S has separated from the photosensitive drum 4K.

With this configuration, the developing roller 10Y is moved to the separated position after the printing medium S has separated from the photosensitive drum 4Y. Next, the developing roller 10M is moved to the separated position after the printing medium S has separated from the photosensitive drum 4M. Next, the developing roller 10C is moved to the separated position after the printing medium S has separated from the photosensitive drum 4C. Next, the developing roller 10K is moved to the separated position after the printing medium S has separated from the photosensitive drum 4K.

Thus, the developing rollers can be separated from the photosensitive drums from which the toner images have been transferred onto the printing medium S, thereby enabling to suppress the photosensitive drums and the developing rollers from being deteriorated.

4. Function and Effect

According to the image forming apparatus 1, the first cam 22Y is rotatable about the first axis A21 that extends in the first direction, as illustrated in FIG. 5. By rotation of the first cam 22Y, the first cam 22Y pushes the first rod 21Y with the first rib 42Y that projects in the first direction to thereby move the first rod 21Y in the first direction.

Further, the second cam 22M is rotatable about the second axis A22 that extends in the first direction. By rotation of the second cam 22M, the second cam 22M pushes the second rod 21M with the second rib 42M that projects in the first direction to move the second rod 21M in the first direction.

That is, the first cam 22Y only has to withstand a reaction force from the first rod 21Y in the first direction in which the first axis A21 extends and the second cam 22M only has to withstand a reaction force from the second rod 21M in the first direction in which the second axis A22 extends.

Accordingly, the strength required for the first cam 22Y and the second cam 22M can be reduced, as compared to a case in which the first cam 22Y needs to withstand a reaction force exerted in a direction crossing the first axis A21 and the second cam 22M needs to withstand a reaction force exerted in a direction crossing the second axis A22.

As a result, the sizes of the first cam 22Y and the second cam 22M can be reduced within an extent that satisfies the required strength.

5. Modifications

Figure 8:
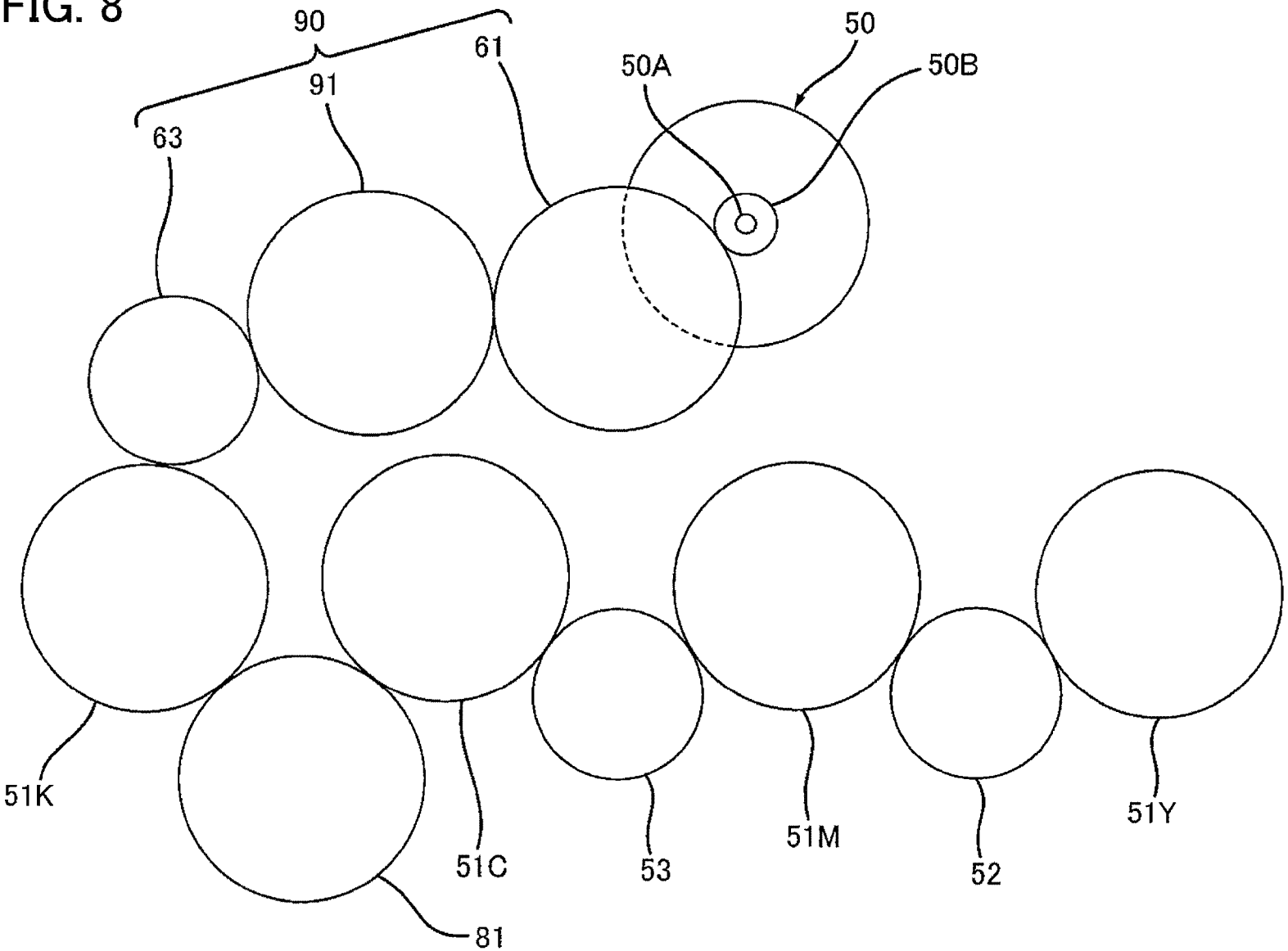
FIG. 8 is an explanation view for explaining modifications of the gear trains.

The gear train 23 need not necessarily include the second gear train 55 that connects the motor 50 and the first gear 51Y (see FIG. 7), and may include a clutch 81 that connects the third gear 51C and the fourth gear 51K, as illustrated in FIG. 8. In other words, the image forming apparatus 1 includes the clutch 81 that connects the third gear 51C and the fourth gear 51K, and a gear train 90 that connects the motor 50 and the fourth gear 51K.

The clutch 81 may be a one-way clutch or an electromagnetic clutch.

In a case where a one-way clutch is employed as the clutch 81, the motor 50 can be switched between forward rotation and reverse rotation. The one-way clutch transmits a motive power from the fourth gear 51K to the third gear 51C when the motor 50 rotates forward. The one-way clutch disengages the power transmission from the fourth gear 51K to the third gear 51C when the motor 50 rotates reversely.

In a case where an electromagnetic clutch is employed as the clutch 81, the motor 50 need not necessarily be capable of being switched between forward rotation and reverse rotation. The electromagnetic clutch can be switched between an ON-state and an OFF-state. The electromagnetic clutch transmits a motive power from the fourth gear 51K to the third gear 51C when the electromagnetic clutch is in the ON-state. The electromagnetic clutch disengages the power transmission from the fourth gear 51K to the third gear 51C when the electromagnetic clutch is in the OFF-state.

The gear train 90 may include a second electromagnetic clutch 91. The second electromagnetic clutch 91 can be switched between an ON-state and an OFF-state. The second electromagnetic clutch 91 transmits a motive power from the motor 50 to the fourth gear 51K when the second electromagnetic clutch 91 is in the ON-state. The second electromagnetic clutch 91 disengages the power transmission from the motor 50 to the fourth gear 51K when the second electromagnetic clutch 91 is in the OFF-state.

Each of the developing units 7Y, 7M, 7C, and 7K in the above-described embodiment may be a developing cartridge that is attachable to the image forming apparatus 1.

Although not illustrated, the image forming apparatus 1 may include a single drum unit that includes the four photosensitive drums 4Y, 4M, 4C, and 4K, and four developing cartridges that are attachable to the drum unit.

Although not illustrated, the image forming apparatus 1 may include a first drum cartridge that includes the photosensitive drum 4Y, a first developing cartridge that is attachable to the first drum cartridge, a second drum cartridge that includes the photosensitive drum 4M, a second developing cartridge that is attachable to the second drum cartridge, a third drum cartridge that includes the photosensitive drum 4C, a third developing cartridge that is attachable to the third drum cartridge, a fourth drum cartridge that includes the photosensitive drum 4K, and a fourth developing cartridge that is attachable to the fourth drum cartridge.

Although not illustrated, the image forming apparatus 1 may include a first process cartridge that includes the photosensitive drum 4Y and the developing unit 7Y, a second process cartridge that includes the photosensitive drum 4M and the developing unit 7M, a third process cartridge that includes the photosensitive drum 4C and the developing unit 7C, and a fourth process cartridge that includes the photosensitive drum 4K and the developing unit 7K.

What is claimed is:

1. An image forming apparatus comprising:

a conveyance belt configured to convey a printing medium;

a first photosensitive drum rotatable about a first drum axis extending in a first direction;

a second photosensitive drum rotatable about a second drum axis extending in the first direction, the second photosensitive drum being positioned downstream of the first photosensitive drum in a second direction that is a direction in which the conveyance belt conveys the printing medium, the second photosensitive drum being positioned spaced apart from the first photosensitive drum in the second direction;

a first developing roller rotatable about a first roller axis extending in the first direction, the first developing roller being movable between a first contact position where the first developing roller is in contact with the first photosensitive drum and a first separated position where the first developing roller is separated from the first photosensitive drum;

a second developing roller rotatable about a second roller axis extending in the first direction, the second developing roller being movable between a second contact position where the second developing roller is in contact with the second photosensitive drum and a second separated position where the second developing roller is separated from the second photosensitive drum;

a first rod for moving the first developing roller from the first contact position to the first separated position, the first rod being movable in the first direction between a first advanced position where the first rod places the first developing roller in the first separated position and a first retracted position where the first rod allows the first developing roller to be positioned in the first contact position;

a second rod for moving the second developing roller from the second contact position to the second separated position, the second rod being movable in the first direction between a second advanced position where the second rod places the second developing roller in the second separated position and a second retracted position where the second rod allows the second developing roller to be positioned in the second contact position;

a first cam rotatable about a first axis extending in the first direction, the first cam being configured to, as the first cam rotates, shift between a first pushing state in which the first cam places the first rod in the first advanced position and a first push-released state in which the first cam allows the first rod to be positioned in the first retracted position;

a second cam rotatable about a second axis extending in the first direction, the second cam being configured to, as the second cam rotates, shift between a second pushing state in which the second cam places the second rod in the second advanced position and a second push-released state in which the second cam allows the second rod to be positioned in the second retracted position;

a first gear rotatable about the first axis together with the first cam;

an idle gear meshingly engaged with the first gear; and a second gear rotatable about the second axis together with the second cam, the second gear being meshingly engaged with the idle gear, wherein a rotation angle of the first cam and a rotation angle of the second cam are offset so that the first cam enters the first pushing state after the printing medium separates from the first photosensitive drum and before the second cam enters the second pushing state, wherein the first cam comprises:

a first disk rotatable together with the first gear; and a first rib positioned on an opposite side of the first disk from the first gear in the first direction, the first rib projecting from the first disk in the first direction, the first rib extending in a circumferential direction of the first disk, the first rib being in contact with the first rod when the first cam is in the first pushing state, the first rib being away from the first rod when the first cam is in the first push-released state, and wherein the second cam comprises:

a second disk rotatable together with the second gear; and a second rib positioned on an opposite side of the second disk from the second gear in the first direction, the second rib projecting from the second disk in the first direction, the second rib extending in a circumferential direction of the second disk, the second rib being in contact with the second rod when the second cam is in the second pushing state, the second rib being away from the second rod when the second cam is in the second push-released state.

2. The image forming apparatus according to claim 1, further comprising:

a third photosensitive drum rotatable about a third drum axis extending in the first direction, the third photosensitive drum being positioned downstream of the second photosensitive drum in the second direction, the third photosensitive drum being positioned spaced apart from the second photosensitive drum in the second direction;

a third developing roller rotatable about a third roller axis extending in the first direction, the third developing roller being movable between a third contact position where the third developing roller is in contact with the third photosensitive drum and a third separated position where the third developing roller is separated from the third photosensitive drum;

a third rod for moving the third developing roller from the third contact position to the third separated position, the third rod being movable in the first direction between a third advanced position where the third rod places the third developing roller in the third separated position and a third retracted position where the third rod allows the third developing roller to be positioned in the third contact position;

a third cam rotatable about a third axis extending in the first direction, the third cam being configured to, as the third cam rotates, shift between a third pushing state in which the third cam places the third rod in the third advanced position and a third push-released state in which the third cam allows the third rod to be positioned in the third retracted position;

a second idle gear meshingly engaged with the second gear; and a third gear rotatable about the third axis together with the third cam, the third gear being meshingly engaged with the second idle gear, wherein the rotation angle of the second cam and a rotation angle of the third cam are offset so that the second cam enters the second pushing state after the printing medium separates from the second photosensitive drum and before the third cam enters the third pushing state.

3. The image forming apparatus according to claim 2, further comprising:

a fourth photosensitive drum rotatable about a fourth drum axis extending in the first direction, the fourth photosensitive drum being positioned downstream of the third photosensitive drum in the second direction, the fourth photosensitive drum being positioned spaced apart from the third photosensitive drum in the second direction;

a fourth developing roller rotatable about a fourth roller axis extending in the first direction, the fourth developing roller being movable between a fourth contact position where the fourth developing roller is in contact with the fourth photosensitive drum and a fourth separated position where the fourth developing roller is separated from the fourth photosensitive drum;

a fourth rod for moving the fourth developing roller from the fourth contact position to the fourth separated position, the fourth rod being movable in the first direction between a fourth advanced position where the fourth rod places the fourth developing roller in the fourth separated position and a fourth retracted position where the fourth rod allows the fourth developing roller to be positioned in the fourth contact position;

a fourth cam rotatable about a fourth axis extending in the first direction, the fourth cam being configured to, as the fourth cam rotates, shift between a fourth pushing state in which the fourth cam places the fourth rod in the fourth advanced position and a fourth push-released state in which the fourth cam allows the fourth rod to be positioned in the fourth retracted position;

a fourth gear rotatable about the fourth axis together with the fourth cam;

a motor switchable between forward rotation and reverse rotation;

a gear train for connecting the motor and the fourth gear; and a one-way clutch for connecting the third gear and the fourth gear, the one-way clutch being configured to:

engage power transmission from the fourth gear to the third gear when the motor rotates forward; and disengage the power transmission from the fourth gear to the third gear when the motor rotates reversely.

4. The image forming apparatus according to claim 2, further comprising:

a fourth photosensitive drum rotatable about a fourth drum axis extending in the first direction, the fourth photosensitive drum being positioned downstream of the third photosensitive drum in the second direction, the fourth photosensitive drum being positioned spaced apart from the third photosensitive drum in the second direction;

a fourth developing roller rotatable about a fourth roller axis extending in the first direction, the fourth developing roller being movable between a fourth contact position where the fourth developing roller is in contact with the fourth photosensitive drum and a fourth separated position where the fourth developing roller is separated from the fourth photosensitive drum;

a fourth rod for moving the fourth developing roller from the fourth contact position to the fourth separated position, the fourth rod being movable in the first direction between a fourth advanced position where the fourth rod places the fourth developing roller in the fourth separated position and a fourth retracted position where the fourth rod allows the fourth developing roller to be positioned in the fourth contact position;

a fourth cam rotatable about a fourth axis extending in the first direction, the fourth cam being configured to, as the fourth cam rotates, shift between a fourth pushing state in which the fourth cam places the fourth rod in the fourth advanced position and a fourth push-released state in which the fourth cam allows the fourth rod to be positioned in the fourth retracted position;

a fourth gear rotatable about the fourth axis together with the fourth cam;

a motor;

a gear train for connecting the motor and the fourth gear; and an electromagnetic clutch for connecting the third gear and the fourth gear, the electromagnetic clutch being switchable between:

an ON-state in which the electromagnetic clutch engages power transmission from the fourth gear to the third gear; and an OFF-state in which the electromagnetic clutch disengages the power transmission from the fourth gear to the third gear.

5. The image forming apparatus according to claim 4, wherein the gear train comprises a second electromagnetic clutch switchable between:

an ON-state in which the second electromagnetic clutch engages power transmission from the motor to the fourth gear; and an OFF-state in which the second electromagnetic clutch disengages the power transmission from the motor to the fourth gear.

6. The image forming apparatus according to claim 2, further comprising:

a fourth photosensitive drum rotatable about a fourth drum axis extending in the first direction, the fourth photosensitive drum being positioned downstream of the third photosensitive drum in the second direction, the fourth photosensitive drum being positioned spaced apart from the third photosensitive drum in the second direction;

a fourth developing roller rotatable about a fourth roller axis extending in the first direction, the fourth developing roller being movable between a fourth contact position where the fourth developing roller is in contact with the fourth photosensitive drum and a fourth separated position where the fourth developing roller is separated from the fourth photosensitive drum;

a fourth rod for moving the fourth developing roller from the fourth contact position to the fourth separated position, the fourth rod being movable in the first direction between a fourth advanced position where the fourth rod places the fourth developing roller in the fourth separated position and a fourth retracted position where the fourth rod allows the fourth developing roller to be positioned in the fourth contact position;

a fourth cam rotatable about a fourth axis extending in the first direction, the fourth cam being configured to, as the fourth cam rotates, shift between a fourth pushing state in which the fourth cam places the fourth rod in the fourth advanced position and a fourth push-released state in which the fourth cam allows the fourth rod to be positioned in the fourth retracted position;

a fourth gear rotatable about the fourth axis together with the fourth cam;

a motor;

a first gear train for connecting the motor and the fourth gear, the first gear train comprising a first electromagnetic clutch switchable between:

an ON-state in which the first electromagnetic clutch engages power transmission from the motor to the fourth gear; and an OFF-state in which the first electromagnetic clutch disengages the power transmission from the motor to the fourth gear; and a second gear train for connecting the motor and the first gear, the second gear train being independent of the first gear train, the second gear train comprising a second electromagnetic clutch switchable between:

an ON-state in which the second electromagnetic clutch engages power transmission from the motor to the first gear; and an OFF-state in which the second electromagnetic clutch disengages the power transmission from the motor to the first gear.

7. The image forming apparatus according to claim 1, wherein the first rod comprises:

a first rod main body extending in the first direction; and a first projection portion projecting from the first rod main body in a direction crossing the first direction, wherein the second rod comprises:

a second rod main body extending in the first direction; and a second projection portion projecting from the second rod main body in a direction crossing the first direction, wherein, when the first cam is in the first pushing state, the first cam pushes the first projection portion to place the first rod in the first advanced position, wherein, when the first cam is in the first push-released state, the first cam does not push the first projection portion to allow the first rod to be positioned in the first retracted position, wherein, when the second cam is in the second pushing state, the second cam pushes the second projection portion to place the second rod in the second advanced position, and wherein, when the second cam is in the second push-released state, the second cam does not push the second projection portion to allow the second rod to be positioned in the second retracted position.

8. An image forming apparatus comprising:

a first photosensitive drum rotatable about a first drum axis extending in an axial direction;

a second photosensitive drum rotatable about a second drum axis extending in the axial direction;

a first developing roller rotatable about a first roller axis extending in the axial direction, the first developing roller being movable between a first contact position where the first developing roller is in contact with the first photosensitive drum and a first separated position where the first developing roller is separated from the first photosensitive drum;

a second developing roller rotatable about a second roller axis extending in the axial direction, the second developing roller being movable between a second contact position where the second developing roller is in contact with the second photosensitive drum and a second separated position where the second developing roller is separated from the second photosensitive drum;

a first rod for moving the first developing roller from the first contact position to the first separated position, the first rod being movable in the axial direction between a first advanced position where the first rod places the first developing roller in the first separated position and a first retracted position where the first rod allows the first developing roller to be positioned in the first contact position;

a second rod for moving the second developing roller from the second contact position to the second separated position, the second rod being movable in the axial direction between a second advanced position where the second rod places the second developing roller in the second separated position and a second retracted position where the second rod allows the second developing roller to be positioned in the second contact position;

a first cam rotatable about a first axis extending in the axial direction, the first cam being configured to, as the first cam rotates, shift between a first pushing state in which the first cam places the first rod in the first advanced position and a first push-released state in which the first cam allows the first rod to be positioned in the first retracted position; and a second cam rotatable about a second axis extending in the axial direction, the second cam being configured to, as the second cam rotates, shift between a second pushing state in which the second cam places the second rod in the second advanced position and a second push-released state in which the second cam allows the second rod to be positioned in the second retracted position, wherein the first cam comprises:

a first disk rotatable about the first axis; and a first rib projecting from a side of the first disk in the axial direction, the first rib extending in a circumferential direction of the first disk, the first rib being in contact with the first rod when the first cam is in the first pushing state, and wherein the second cam comprises:

a second disk rotatable about the second axis; and a second rib projecting from a side of the second disk in the axial direction, the second rib extending in a circumferential direction of the second disk, the second rib being in contact with the second rod when the second cam is in the second pushing state.

9. The image forming apparatus according to claim 8, further comprising:

a third photosensitive drum rotatable about a third drum axis extending in the axial direction;

a third developing roller rotatable about a third roller axis extending in the axial direction, the third developing roller being movable between a third contact position where the third developing roller is in contact with the third photosensitive drum and a third separated position where the third developing roller is separated from the third photosensitive drum;

a third rod for moving the third developing roller from the third contact position to the third separated position, the third rod being movable in the axial direction between a third advanced position where the third rod places the third developing roller in the third separated position and a third retracted position where the third rod allows the third developing roller to be positioned in the third contact position; and a third cam rotatable about a third axis extending in the axial direction, the third cam being configured to, as the third cam rotates, shift between a third pushing state in which the third cam places the third rod in the third advanced position and a third push-released state in which the third cam allows the third rod to be positioned in the third retracted position.

10. The image forming apparatus according to claim 9, further comprising:

a fourth photosensitive drum rotatable about a fourth drum axis extending in the axial direction;

a fourth developing roller rotatable about a fourth roller axis extending in the axial direction, the fourth developing roller being movable between a fourth contact position where the fourth developing roller is in contact with the fourth photosensitive drum and a fourth separated position where the fourth developing roller is separated from the fourth photosensitive drum;

a fourth rod for moving the fourth developing roller from the fourth contact position to the fourth separated position, the fourth rod being movable in the axial direction between a fourth advanced position where the fourth rod places the fourth developing roller in the fourth separated position and a fourth retracted position where the fourth rod allows the fourth developing roller to be positioned in the fourth contact position;

a fourth cam rotatable about a fourth axis extending in the axial direction, the fourth cam being configured to, as the fourth cam rotates, shift between a fourth pushing state in which the fourth cam places the fourth rod in the fourth advanced position and a fourth push-released state in which the fourth cam allows the fourth rod to be positioned in the fourth retracted position;

a first gear rotatable about the first axis together with the first cam;

a first idle gear engaged with the first gear;

a second gear rotatable about the second axis together with the second cam, the second gear being engaged with the first idle gear;

a second idle gear engaged with the second gear;

a third gear rotatable about the third axis together with the third cam, the third gear being engaged with the second idle gear;

a fourth gear rotatable about the fourth axis together with the fourth cam;

a motor switchable between forward rotation and reverse rotation;

a gear train for connecting the motor and the fourth gear; and a one-way clutch for connecting the third gear and the fourth gear, the one-way clutch being configured to:

engage power transmission from the fourth gear to the third gear when the motor rotates forward; and disengage the power transmission from the fourth gear to the third gear when the motor rotates reversely.

11. The image forming apparatus according to claim 9, further comprising:

a fourth photosensitive drum rotatable about a fourth drum axis extending in the axial direction;

a fourth developing roller rotatable about a fourth roller axis extending in the axial direction, the fourth developing roller being movable between a fourth contact position where the fourth developing roller is in contact with the fourth photosensitive drum and a fourth separated position where the fourth developing roller is separated from the fourth photosensitive drum;

a fourth rod for moving the fourth developing roller from the fourth contact position to the fourth separated position, the fourth rod being movable in the axial direction between a fourth advanced position where the fourth rod places the fourth developing roller in the fourth separated position and a fourth retracted position where the fourth rod allows the fourth developing roller to be positioned in the fourth contact position;

a fourth cam rotatable about a fourth axis extending in the axial direction, the fourth cam being configured to, as the fourth cam rotates, shift between a fourth pushing state in which the fourth cam places the fourth rod in the fourth advanced position and a fourth push-released state in which the fourth cam allows the fourth rod to be positioned in the fourth retracted position;

a first gear rotatable about the first axis together with the first cam;

a first idle gear engaged with the first gear;

a second gear rotatable about the second axis together with the second cam, the second gear being engaged with the first idle gear;

a second idle gear engaged with the second gear;

a third gear rotatable about the third axis together with the third cam, the third gear being engaged with the second idle gear;

a fourth gear rotatable about the fourth axis together with the fourth cam;

a motor;

a gear train for connecting the motor and the fourth gear; and an electromagnetic clutch for connecting the third gear and the fourth gear, the electromagnetic clutch being switchable between:

an ON-state in which the electromagnetic clutch engages power transmission from the fourth gear to the third gear; and an OFF-state in which the electromagnetic clutch disengages the power transmission from the fourth gear to the third gear.

12. The image forming apparatus according to claim 11, wherein the gear train comprises a second electromagnetic clutch switchable between:

an ON-state in which the second electromagnetic clutch engages power transmission from the motor to the fourth gear; and an OFF-state in which the second electromagnetic clutch disengages the power transmission from the motor to the fourth gear.

13. The image forming apparatus according to claim 9, further comprising:

a fourth photosensitive drum rotatable about a fourth drum axis extending in the axial direction;

a fourth developing roller rotatable about a fourth roller axis extending in the axial direction, the fourth developing roller being movable between a fourth contact position where the fourth developing roller is in contact with the fourth photosensitive drum and a fourth separated position where the fourth developing roller is separated from the fourth photosensitive drum;

a fourth rod for moving the fourth developing roller from the fourth contact position to the fourth separated position, the fourth rod being movable in the axial direction between a fourth advanced position where the fourth rod places the fourth developing roller in the fourth separated position and a fourth retracted position where the fourth rod allows the fourth developing roller to be positioned in the fourth contact position;

a fourth cam rotatable about a fourth axis extending in the axial direction, the fourth cam being configured to, as the fourth cam rotates, shift between a fourth pushing state in which the fourth cam places the fourth rod in the fourth advanced position and a fourth push-released state in which the fourth cam allows the fourth rod to be positioned in the fourth retracted position;

a first gear rotatable about the first axis together with the first cam;

a first idle gear engaged with the first gear;

a second gear rotatable about the second axis together with the second cam, the second gear being engaged with the first idle gear;

a second idle gear engaged with the second gear;

a third gear rotatable about the third axis together with the third cam, the third gear being engaged with the second idle gear;

a fourth gear rotatable about the fourth axis together with the fourth cam;

a motor;

a first gear train for connecting the motor and the fourth gear, the first gear train comprising a first electromagnetic clutch switchable between:

an ON-state in which the first electromagnetic clutch engages power transmission from the motor to the fourth gear; and an OFF-state in which the first electromagnetic clutch disengages the power transmission from the motor to the fourth gear; and a second gear train for connecting the motor and the first gear, the second gear train being independent of the first gear train, the second gear train comprising a second electromagnetic clutch switchable between:

an ON-state in which the second electromagnetic clutch engages power transmission from the motor to the first gear; and an OFF-state in which the second electromagnetic clutch disengages the power transmission from the motor to the first gear.

14. The image forming apparatus according to claim 8, wherein the first rod comprises:

a first rod main body extending in the axial direction; and a first projection portion projecting from the first rod main body in a direction crossing the axial direction, wherein the second rod comprises:

a second rod main body extending in the axial direction; and a second projection portion projecting from the second rod main body in a direction crossing the axial direction, wherein, when the first cam is in the first pushing state, the first cam pushes the first projection portion to place the first rod in the first advanced position, wherein, when the first cam is in the first push-released state, the first cam does not push the first projection portion to allow the first rod to be positioned in the first retracted position, wherein, when the second cam is in the second pushing state, the second cam pushes the second projection portion to place the second rod in the second advanced position, and wherein, when the second cam is in the second push-released state, the second cam does not push the second projection portion to allow the second rod to be positioned in the second retracted position.

15. An image forming apparatus comprising:

a first photosensitive drum;

a second photosensitive drum;

a first developing roller movable between:

a first contact position where the first developing roller is in contact with the first photosensitive drum; and a first separated position where the first developing roller is separated from the first photosensitive drum;

a second developing roller movable between:

a second contact position where the second developing roller is in contact with the second photosensitive drum; and a second separated position where the second developing roller is separated from the second photosensitive drum;

a first rod for moving the first developing roller from the first contact position to the first separated position, the first rod being movable between:

a first advanced position where the first rod places the first developing roller in the first separated position; and a first retracted position where the first rod allows the first developing roller to be positioned in the first contact position;

a second rod for moving the second developing roller from the second contact position to the second separated position, the second rod being movable between:

a second advanced position where the second rod places the second developing roller in the second separated position; and a second retracted position where the second rod allows the second developing roller to be positioned in the second contact position;

a first cam configured to, as the first cam rotates, shift between:

a first pushing state in which the first cam places the first rod in the first advanced position; and a first push-released state in which the first cam allows the first rod to be positioned in the first retracted position, the first cam including:

a first disk; and a first rib projecting from a side of the first disk and extending in a circumferential direction of the first disk, the first rib being in contact with the first rod when the first cam is in the first pushing state; and a second cam configured to, as the second cam rotates, shift between:

a second pushing state in which the second cam places the second rod in the second advanced position; and a second push-released state in which the second cam allows the second rod to be positioned in the second retracted position, the second cam including:

a second disk; and a second rib projecting from a side of the second disk and extending in a circumferential direction of the second disk, the second rib being in contact with the second rod when the second cam is in the second pushing state.

16. An image forming apparatus comprising:

a photosensitive drum;

a developing roller movable between a contact position where the developing roller is in contact with the photosensitive drum and a separated position where the developing roller is separated from the photosensitive drum;

a rod for moving the developing roller from the contact position to the separated position, the rod being movable between an advanced position where the rod places the developing roller in the separated position and a retracted position where the rod allows the developing roller to be positioned in the contact position; and a cam configured to, as the cam rotates, shift between a pushing state in which the cam places the rod in the advanced position and a push-released state in which the cam allows the rod to be positioned in the retracted position, the cam including:

a disk; and a rib projecting from a side of the disk and extending in a circumferential direction of the disk, the rib being in contact with the rod when the cam is in the pushing state.

* * * * *